US011553751B2

(12) United States Patent
Oh

(10) Patent No.: US 11,553,751 B2
(45) Date of Patent: Jan. 17, 2023

(54) CAP EQUIPPED WITH LIGHT EMITTING DEVICE

(71) Applicant: Young Sook Oh, Daegu (KR)

(72) Inventor: Young Sook Oh, Daegu (KR)

( * ) Notice: Subject to any disclaimer, the term of this patent is extended or adjusted under 35 U.S.C. 154(b) by 303 days.

(21) Appl. No.: 16/958,146

(22) PCT Filed: Jul. 3, 2019

(86) PCT No.: PCT/KR2019/008105
§ 371 (c)(1),
(2) Date: Jun. 25, 2020

(87) PCT Pub. No.: WO2020/262747
PCT Pub. Date: Dec. 30, 2020

(65) Prior Publication Data

US 2022/0264983 A1 Aug. 25, 2022

(30) Foreign Application Priority Data

Jun. 28, 2019 (KR) ..... 10-2019-0077615

(51) Int. Cl.

| | |
|---|---|
| ***A42B 1/244*** | (2021.01) |
| ***F21K 9/60*** | (2016.01) |
| ***A42B 1/004*** | (2021.01) |
| ***F21V 33/00*** | (2006.01) |

(52) U.S. Cl.
CPC ..... *A42B 1/244* (2013.01); *A42B 1/004* (2013.01); *F21K 9/60* (2016.08); *F21V 33/0008* (2013.01)

(58) Field of Classification Search
CPC ..... A42B 1/004; A42B 1/244; F21K 9/60; F21V 33/0008
See application file for complete search history.

(56) References Cited

U.S. PATENT DOCUMENTS 5,111,366 A * 5/1992 Rife ..... G02B 6/0095 2/209.13

* cited by examiner

*Primary Examiner* — Thomas M Sember

(57) ABSTRACT

The present invention relates to a cap equipped with a light emitting device, the cap comprises a body part 10 having a space portion 101 formed therein to receive a wearer's head through an opening of the space portion formed downward; a brim part 20 formed to be protruded frontward at a bottom of the body part 10; a light penetrating member 30, 31 attached to a front side of the body part 10 and made of material that light penetrates through, and a light emitting module 40 installed at one side of the body part to emit light through the light penetrating member 30, 31.

According to the present invention, the cap equipped with the light emitting device improves merchantability of the cap as a fashion accessory by enhancing the cap's recognition at night and an aesthetic impression by light emitting.

4 Claims, 8 Drawing Sheets

CAP EQUIPPED WITH LIGHT EMITTING DEVICE

TECHNICAL FIELD

The present invention is related to a cap equipped with a light emitting device, and more particularly to a cap with a light emitting device of which merchantability is more improved by enhancing the cap's recognition at night and an aesthetic impression through a design or a mark attached to the cap emitting light by the light emitting device.

BACKGROUND ART

Generally, a hat refers to a headgear which is worn on a wearer's head.

The hat can be divided into one without a brim and the other with a brim. The hat without the brim is usually used for protecting a wearer's head from cold or heat, and the hat with the brim is mostly used for preventing UV of the strong sunlight from illuminating to eyes.

In the past, hats were mainly used for the functional purpose as described above; however, these days, they are utilized for various purposes such as fashion accessories or representing one's social position.

Meanwhile, hats may be incorporated with diverse decorations, such as embroidery or wappen patches, for enhancing merchantability of the hats. However, there were limits to increase merchantabilities of the hats because these traditional ornaments did not have certain functions, and they could not be recognized at night.

Accordingly, it had been suggested to attach luminescent sticky tape or stickers on the hats, but these can be attached to hats with hard and smooth surface such as plastic or metal strongly while loosely attached to hats made of clothing or non-woven fabric.

In addition, because materials of luminescent sticky tape or stickers was able to enhance visibility only by reflecting light, it did not have the excellent visibility effects in a place where there is little light.

Recently, a hat equipped light emitting device using LED have been developed.

However, this LED hat has drawbacks to hurt people's eyes around the wearer because strong light from this LED hat is emitted forward due to its straightness characteristic.

Furthermore, the light emitting part of this traditional LED hat is exposed to outside the hat, which disrupts exterior design of the hat itself.

Also, this hat needs to include multiple light emitting means which can emit various kinds of colored lights, which lead to an increase of manufacturing costs.

DETAILED DESCRIPTION

Detailed Description of the Invention

Technical Problem

To solve the problem of the traditional LED hat as described above, the present invention provides a cap equipped with light emitting device including a design patch or a mark attached to the cap emitting light by emitting means.

The present invention also provides a cap equipped with a light emitting device which prevents strong light of the device from hurting others' eyes.

In addition, the present invention provides a cap equipped with a light emitting device which is not exposed to outside.

The present invention provides a cap equipped with a light emitting device which can emit multiple color light through single-colored light emitting means.

Technical Solution

To solve the problems as described above, a cap equipped with light emitting device of the present invention comprises:

a body part 10 having a space portion 101 formed therein to receive a wearer's head through an opening of the space portion formed downward;

a brim part 20 formed to be protruded frontward at a bottom of the body part 10;

a light penetrating member 30 attached to a front side of the body part 10 and made of material that light penetrates through, and a light emitting module 40 installed at one side of the body part 10 to emit light through the light penetrating member.

In one embodiment, the light penetrating member 30 comprises:

a base part 301 attached to the front side of the body part 10 and made of an opaque silicone material having a first hue, and a light penetrating surface part 302 formed to be protruded frontward from a center of the base part 301 and allowing a receiving space portion 302*a* formed in rear of the light penetrating surface part 302 to receive the light emitting module 40.

In one embodiment, the body part 10 further comprises:

a penetrating opening formed at the front side of the body part, and a pocket portion 103 formed in rear of the penetrating opening within the space portion 101;

the light penetrating member 31 comprises:

a patch portion 311 attached to the front side of the body part 10 to be located in front of the penetrating opening and made of material that light penetrates through, and a first embroidery portion 312 formed in a front side of the patch portion 311 and made of transparent thread, wherein the light emitting module 30 is installed inside the pocket portion 103 in an accessible form to put the light emitting module 40 in and out of the pocket portion 103.

In one embodiment, the light penetrating member 31 further comprises:

at least one of second embroidery portion 312 formed at one side of the first embroidery portion 311 and made of transparent thread having a different color from that of the first embroidery portion 311.

In one embodiment, a cap equipped with a light emitting device comprises: a body part 10 having a space portion 101 formed therein to receive a wearer's head through an opening of the space portion formed downward and comprising a light penetrating member 104 made of material that light penetrates through in a front side of the body part 10;

a brim part 20 formed to be protruded frontward at a bottom of the body part 10;

a pocket portion 103 formed in rear of the light penetrating member 104 within the space portion, and a light emitting module 40 installed inside the pocket portion 103 in an accessible form to put the light emitting module 40 in and out of the pocket portion.

Advantageous Effects

According to the present invention, merchantability of the cap as fashion accessories is improved by enhancing the cap's recognition at night and an aesthetic impression through a design patch or a mark attached to the cap emitting light by light emitting means.

Also, the present invention raises ease of use by preventing strong light of the light emitting device from hurting others' eyes and prevents degradation of the outer design of the cap by not exposing the light emitting mean to outside.

In addition, the present invention reduces manufacturing costs and maximizes quality of the cap by emitting multiple color light through single-colored light emitting means.

MODE FOR INVENTION

Hereinafter, the present invention is described with reference to the accompanying drawings. The embodiments of the present invention are provided so that this disclosure will be thorough and complete and will fully convey the concept of the invention to those skilled in the art. The description of the present invention, however, are embodiments for structural or functional explanation, and the scope of the present invention should not be construed as being limited to the embodiments set forth herein. The present invention may, however, be embodied in many different forms and should not be construed as being limited to the embodiments set forth herein. Various modifications are possible in various embodiments of the present invention. Thus, it is intended that the present invention include modifications and variations of the present invention that are within the scope of the appended claims and their equivalents.

Terms used in the present disclosure should be understood as following.

The terms such as "1st," "2nd," "first," "second," and the like used herein may be used to distinguish one element from another element. Such terms do not limit the scope of the present invention. For example, a first component may be referred to as a second component and vice versa. When one element is referred to as being "connected" to another element, it should be understood that the former can be "directly connected" to the latter or connected to the latter via an intervening element. It will be further understood that when one component is referred to as being "directly connected" or "directly linked" to another component, it indicates that no intervening component is present. Other words used to describe the relationship between elements should be interpreted in a like fashion (e.g., "between" versus "directly between," "adjacent" versus "directly adjacent," etc.).

The terms of a singular form may include plural forms unless otherwise specified. The terms "include," "comprise," or "have" used herein indicate disclosed a property, a fixed number, a step, operations, an element, a component, or the existence of a combination of these elements, but does not exclude other a property, a fixed number, a step, operations, an element, a component, or the existence of a combination of these elements.

Figure 1:
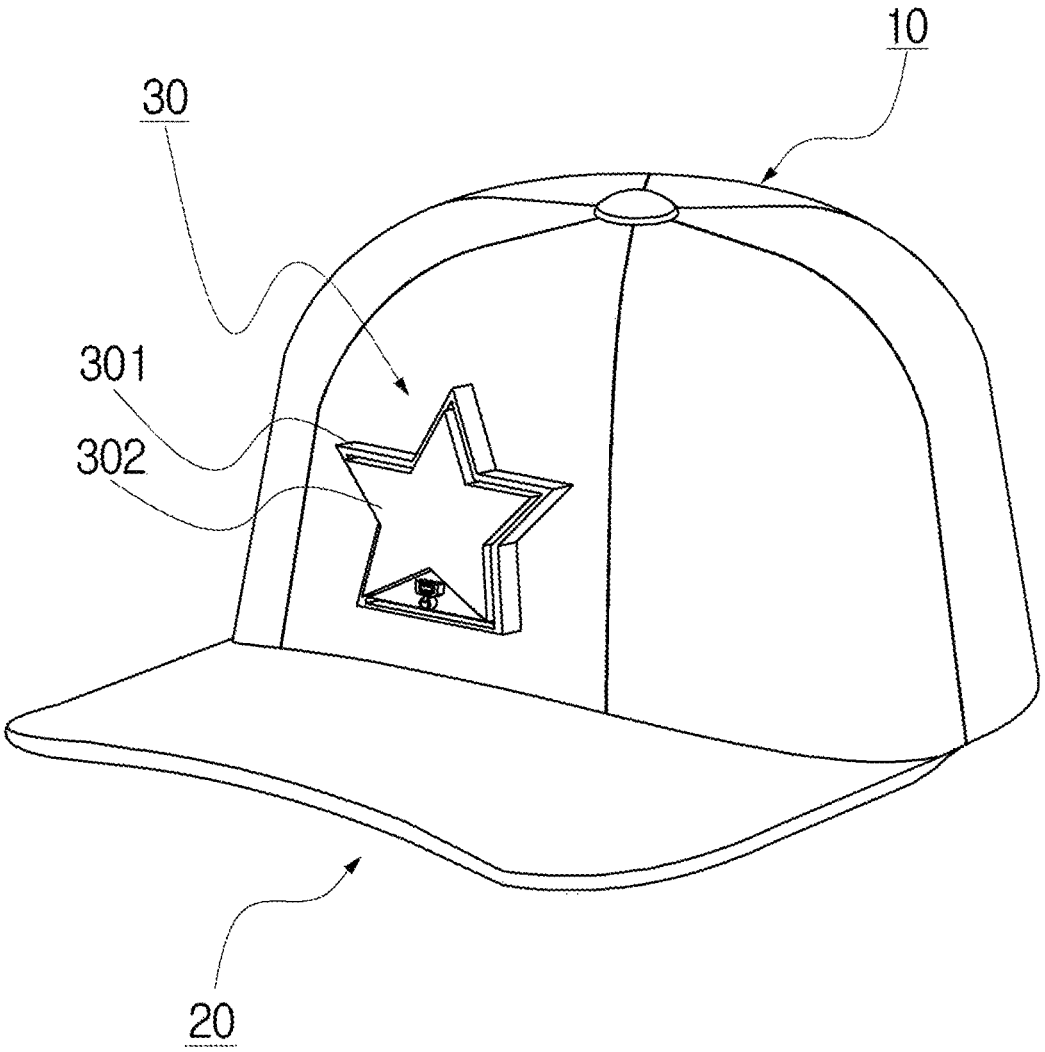
FIG. 1 is a perspective view of a cap equipped with a light emitting device according to one embodiment of the present invention.
Figure 2:
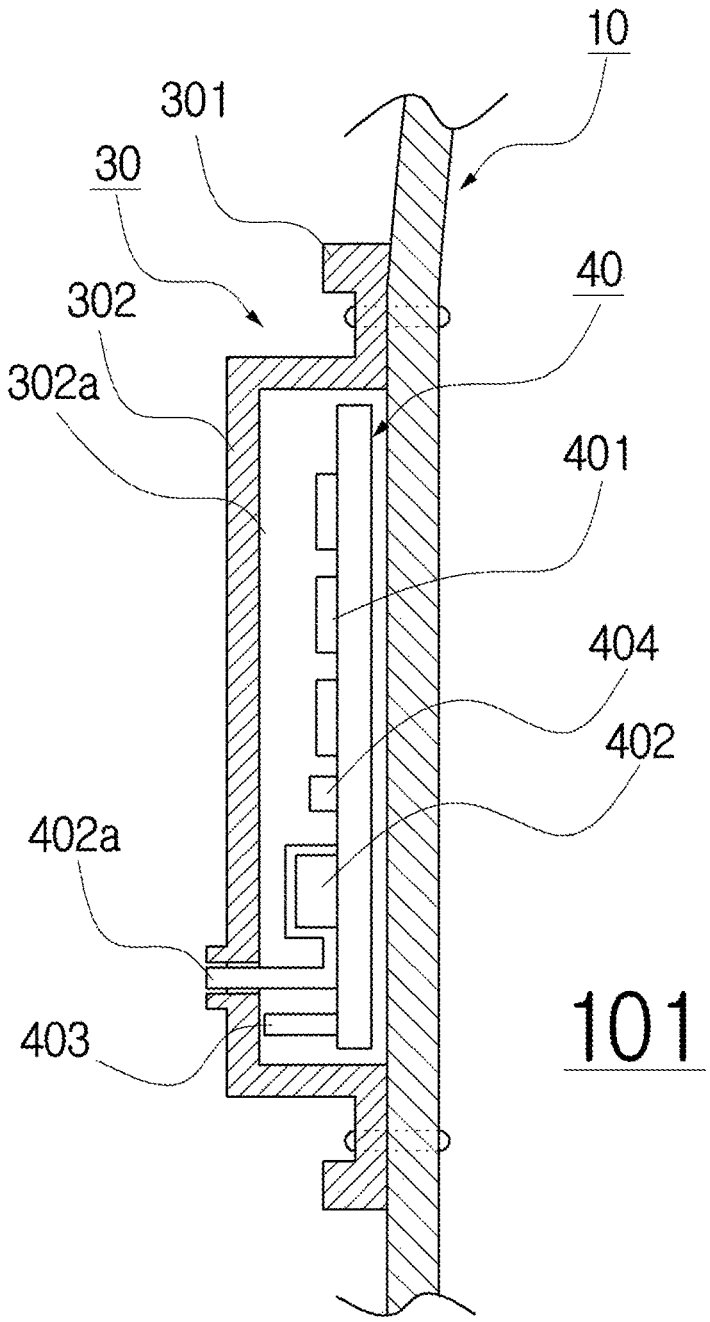
FIG. 2 is a side cross-sectional view of a cap equipped with a light emitting device according to one embodiment of the present invention.

Unless otherwise defined herein, all of the terms used herein, which include technical or scientific terms, may have the same meaning that is generally understood by a person skilled in the art. It will be further understood that terms, which are defined in a dictionary and commonly used, should also be interpreted as is customary in the relevant related art, and should not be interpreted in an idealized or overly formal sense unless expressly so defined herein in various embodiments of the present FIG. 1 is a perspective view of a cap equipped with a light emitting device according to one embodiment of the present invention. FIG. 2 is a front view of a cap equipped with a light emitting device according to one embodiment of the present invention.

The present invention is explained referring to FIGS. 1 and 2.

A cap equipped with a light emitting device of the present invention comprises a body part 10, a brim part 20, a light penetrating member 30, 31, and a light emitting module 40.

The body part 10 has a space portion 101 formed therein to receive a wearer's head through an opening of the space portion formed downward.

The body part 10 is preferably made of woven fabric or sewed pieces of fabrics in a radical shape to form the space portion 101 in which a wearer's head is inserted. However, the material of the body part is not limited to as mentioned above, and it may be made of various kinds of materials such as synthetic materials and can be manufactured by an injection molding method stamping out repeatedly using a mold.

The brim part 20 is formed to be protruded frontward at a bottom of the body part 10.

Thus, an inner end of the brim part 20 is sewed to the bottom of the body part 10, and the brim part 20 is formed to be protruded frontward from the body part 10, which prevents sunlight.

The light penetrating member 30 is made of material that light penetrates through and has a form of a design patch or a mark at a front side of the body part 10 to emit light by receiving light from the light emitting device 40. The light penetrating member 30 comprises a base part 301 and a light penetrating surface part 302 for ease of attachment and efficiency of light penetration.

The base part 301 is made of an opaque silicone material having a first hue and attached to the front side of the body part 10.

The attachment of the base part 301 is preferably performed by sewing but is not limited to. Any methods can be used to fix the base part 301 to the body part 10 of the cap, such as adhesion, heat boding, etc.

The light penetrating surface part 302 is made of an opaque silicone material having a second hue, formed to be protruded frontward from a center of the base part 10, and allowing a receiving space portion 302*a* formed in rear of the light penetrating surface part 302 to receive the light emitting module 40.

In this case, charger terminals of the light emitting module 40 may be formed to be exposed to a front side of the light penetrating surface part 302.

Accordingly, when the light emitting module 40 installed inside the receiving space portion 302*a* emits light, light is seen through the light penetrating surface part 302 made of the opaque silicone material, and eye damage can be prevented which is occurred when strong light generated from the light emitting module 40 is directly emitted to outside.

Also, the light penetrating surface part 302 has a second hue which is different from that of the base part 301, and the light seen through the light penetrating surface part 302 is seen in a different color from the base part 301.

In addition, when the base part 301 and the light penetrating surface part 302 are made of silicone material, a fluorescent pigment or a phosphorescent pigment may be mixed with the silicone material. In this case, recognition at night can be enhanced without the light emitting device 40.

The light emitting module 40 is installed at one side of the body part 10 to allow emitted light to be seen through the light penetrating surface part 30. The light emitting module 40 comprises a light emitting mean 401, a power supply portion 402, a switch 403, and a controller potion 404.

The light emitting module 40 comprises at least one or more of LED to generate light, and more particularly, it is preferable that the light emitting module 40 comprises a LED panel that a plurality of LEDs are arranged on a PCB.

The power supply part 502 is an element to supply power. The power supply part 502 is preferably equipped with a lithium ion battery, which is capable of repetitive charging, and a charger terminal.

The switch 403 is preferably installed at one side of the light emitting mean 401 or one side of the power supply part 402 to be electrically connected to the light emitting mean 401 and power supply part 402 to control the supply of power.

The controller part 404 is preferably equipped with a driving circuit to control light emitting of the light emitting mean 401 when the controller part 404 is electrically connected to the light emitting mean 401, the power supply 402, and the switch 403, the power supply part 402 supplies power into the light emitting mean 401, and the light emitting mean 401 emits light.

Thus, the controller part 404 allows the light emitting mean 401 to be lights-off, lights-on, or intermittent lights-on.

The light emitting module 40 may further comprise a coating layer of resin covering the whole exterior of the cap except the charger terminals to keep it waterproof.

The light emitting module 40 is prevented from wet damage by washing the cap with a protection through the coating layer.

Figure 3:
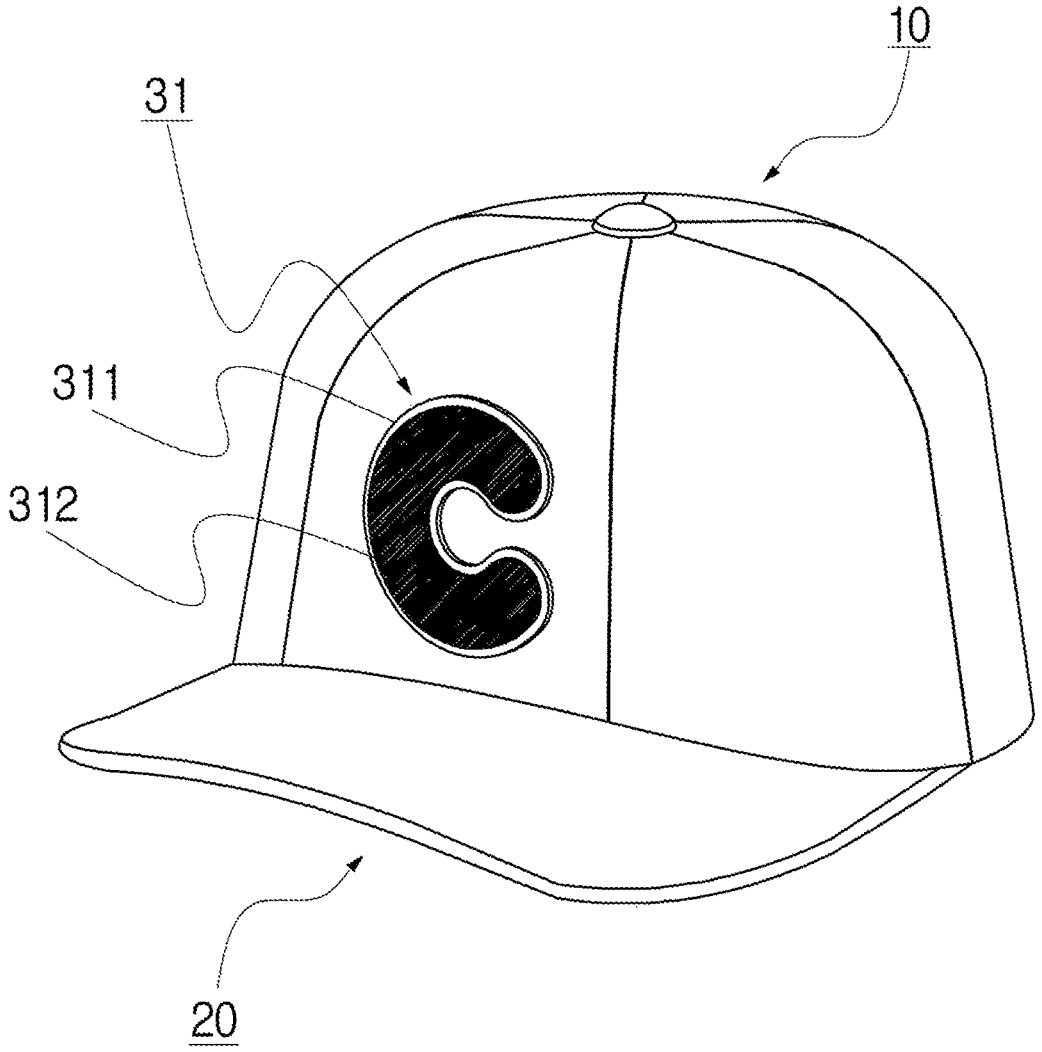
FIG. 3 is a perspective view of a cap equipped with a light emitting device according to a second embodiment of the present invention.
Figure 4:
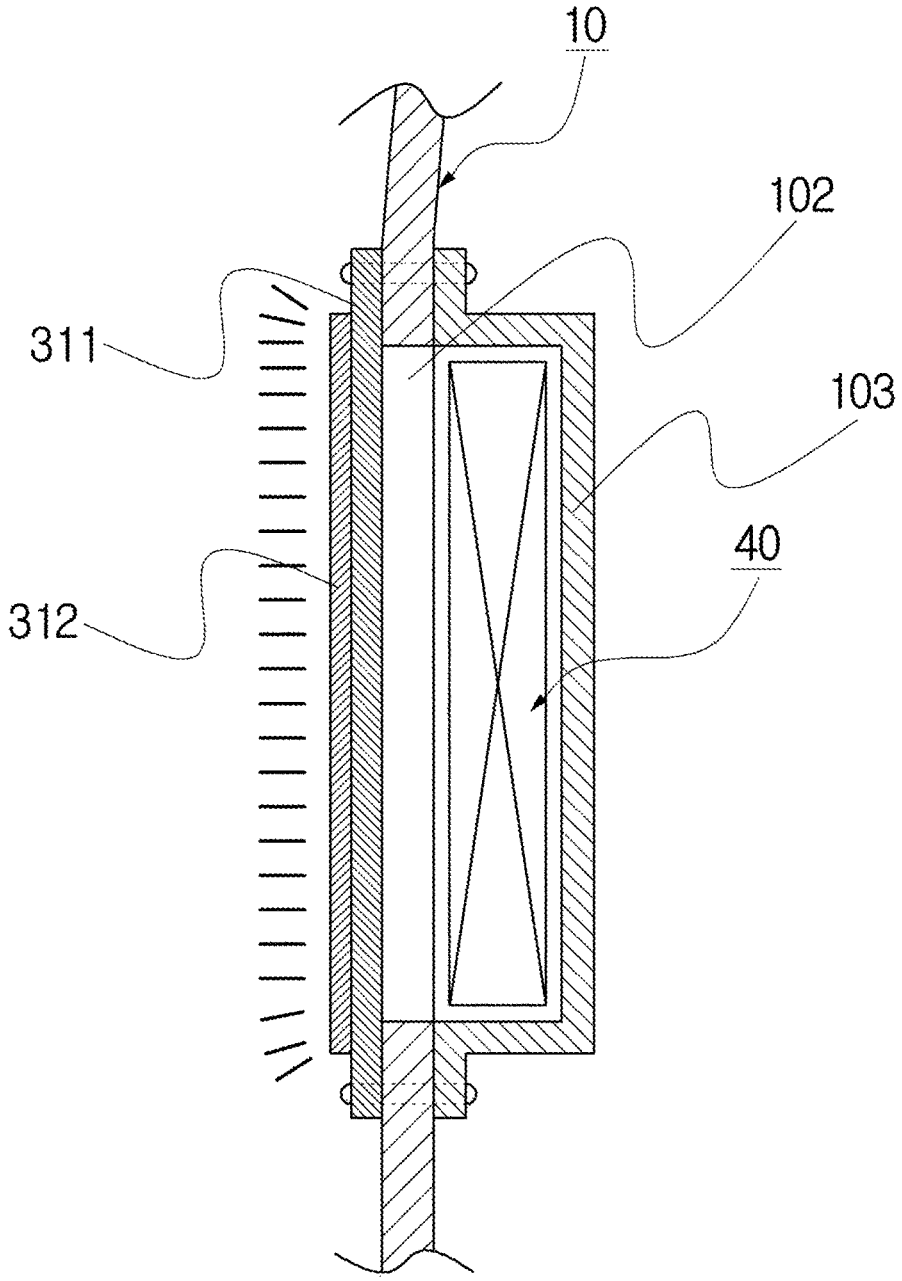
FIG. 4 is a side cross-sectional view of a cap equipped with a light emitting device according to the second embodiment of the present invention.

FIG. 3 is a perspective view of a cap equipped with a light emitting device according to a second embodiment of the present invention. FIG. 4 is a side cross-sectional view of a cap equipped with a light emitting device according to the second embodiment of the present invention.

The present invention is explained referring to FIGS. 3 and 4.

The body part 10 further comprises a penetrating opening and a pocket portion 103.

The penetrating opening is formed at the front side of the body part 10.

The pocket portion 103 is formed in rear of the penetrating opening within the space portion 101 of the body part 10.

Thus, the pocket portion 103 is formed by attaching a piece of fabric bigger than an area of the penetrating opening to an inner side of the body part 10 allowing an opening at one side. Accordingly, the light emitting module 40 can be installed inside the pocket portion 103 in an accessible form to put the light emitting module in and out of the pocket portion 103 through the opening.

The pocket portion 103 is preferably formed by sewing three sides of the fabric piece except the opening to the body part 10 but not limited to. The three sides may be detachable from the body part 10 by fixing them to the body part 10 through various fastening means such as Velcro fasteners, snap buttons, magnetic buttons, etc.

Furthermore, to prevent the light emitting module 40 from escaping from the pocket portion 103, the opening of the pocket portion 103 further comprises various fastening means such as Velcro fasteners, snap buttons, magnetic buttons, etc.

The light penetrating member 31 according to the second embodiment is made of a material that light penetrate through, attached to the front side of the body part 103, and emits light by receiving light from the light emitting module 40. The light penetrating member 31 comprises a patch portion 311 and a first embroidery portion 312.

The patch portion 311 is made of a material that light penetrate through and attached to a front side of the body part 10 to be located in front of the penetrating opening.

The attachment of the patch portion 311 is preferably performed by sewing but is not limited to. Any methods can be used to fix the patch portion 311 to the body part 10 of the cap, such as adhesion, heat boding, etc.

Also, a material of the patch portion 311 that light penetrate through may be selected among one of silicone, fabric, net, synthetic resin film, non-woven fabric, but is not limited to.

A first embroidery portion 312 is formed in a certain shape at a front side of the patch portion 311 and made of transparent thread.

Thus, the first embroidery portion 312 is formed in a certain shape at a front side of the patch portion 311 by an embroidering machine using a transparent thread that light penetrates through. The transparent thread may be a colorless transparent thread or a colored transparent thread.

Therefore, when the light emitting mean 401 of the light emitting module 40 received in the pocket portion 103 is turned off, the cap equipped with the light emitting module of the present invention shows an aesthetic impression from embroidery decorations by the first embroidery portion 312 at the front side of the body part 10.

On the other hand, when the light emitting mean 401 of the light emitting module 40 received in the pocket portion 103 is turned on, the first embroidery portion 312 shines brightly by the light emitting mean 401 and shows a more fancy and colorful appearance.

Especially, in a case that the transparent thread consisting of the first embroidery portion 312 is colorless thread, colors of lights emitted from the light emitting mean 401 are directly seen through the first embroidery portion 312; therefore, various colored lights emitted from the emitting mean 401 can be appeared.

In addition, in a case that the transparent thread consisting of the first embroidery portion 312 is colored thread, a color of light emitted from the light emitting mean 401 can be seen in colors of the colored thread consisting of the first embroidery portion 312.

Figure 5:
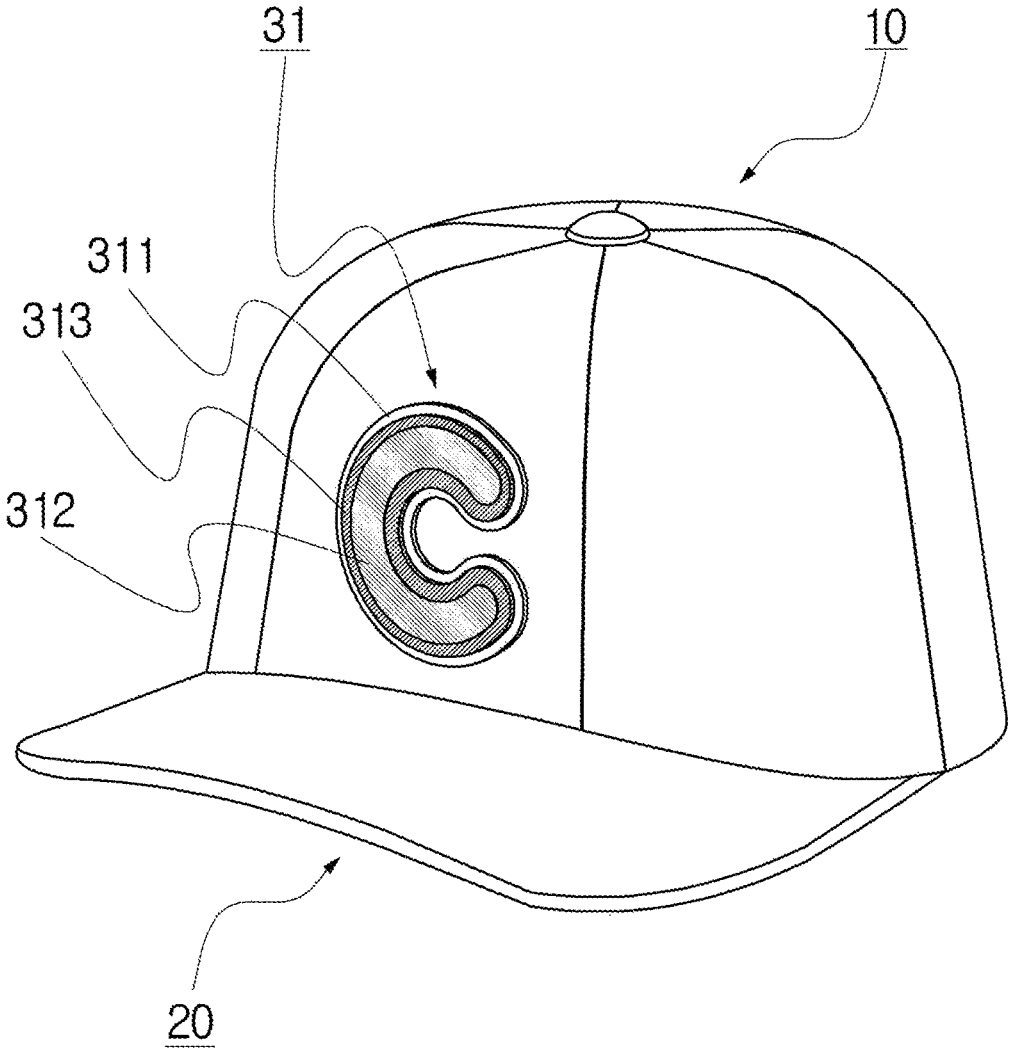
FIG. 5 is a perspective view of a cap equipped with a light emitting device according to a third embodiment of the present invention.
Figure 6:
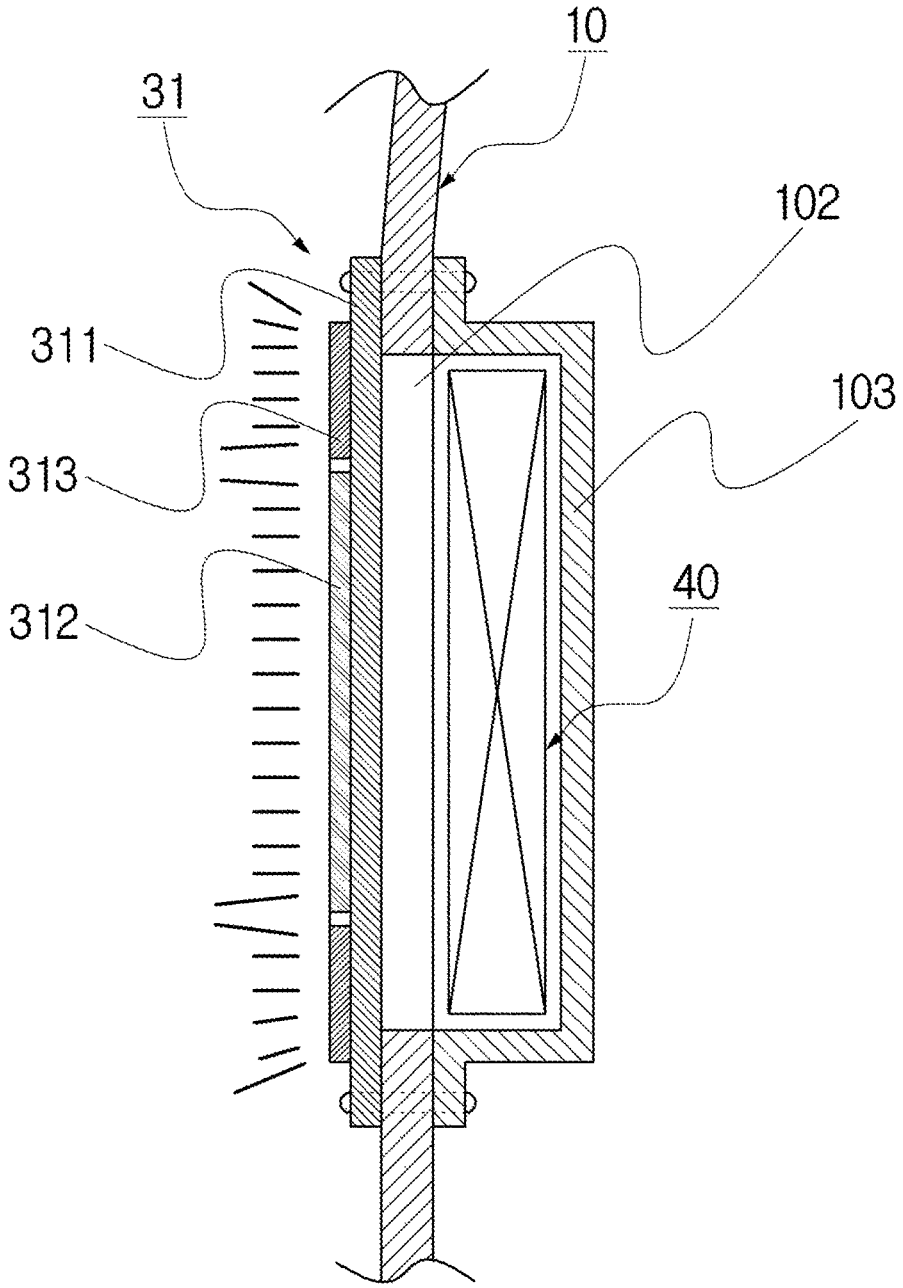
FIG. 6 is a side cross-sectional view of a cap equipped with a light emitting device according to the third embodiment of the present invention.

FIG. 5 is a perspective view of a cap equipped with a light emitting device according to a third embodiment of the present invention. FIG. 6 is a side cross-sectional view of a cap equipped with a light emitting device according to the third embodiment of the present invention.

The present invention is explained referring to FIGS. 5 and 6.

The light penetrating member 31 further comprises at least one of second embroidery portion 313.

The second embroidery portion 313 is formed at one side of the first embroidery portion 312 and made of transparent thread having a different color from that of the first embroidery portion 312.

Thus, the second embroidery portion 313 is made of transparent thread having a different color from that of the first embroidery portion 312 and can form a certain pattern or a design with the first embroidery portion 312 by being mixed with the first embroidery portion 312, being formed at one side of the first embroidery portion 312, or being formed along the edge of the first embroidery portion 312.

Even though single-colored light is emitted from the light emitting mean 401, different colored lights can be shown by the first embroidery portion 312 and the second embroidery portion 313 which have different color each other. This enables to reduce manufacturing costs and maximize the quality of the cap.

Figure 7:
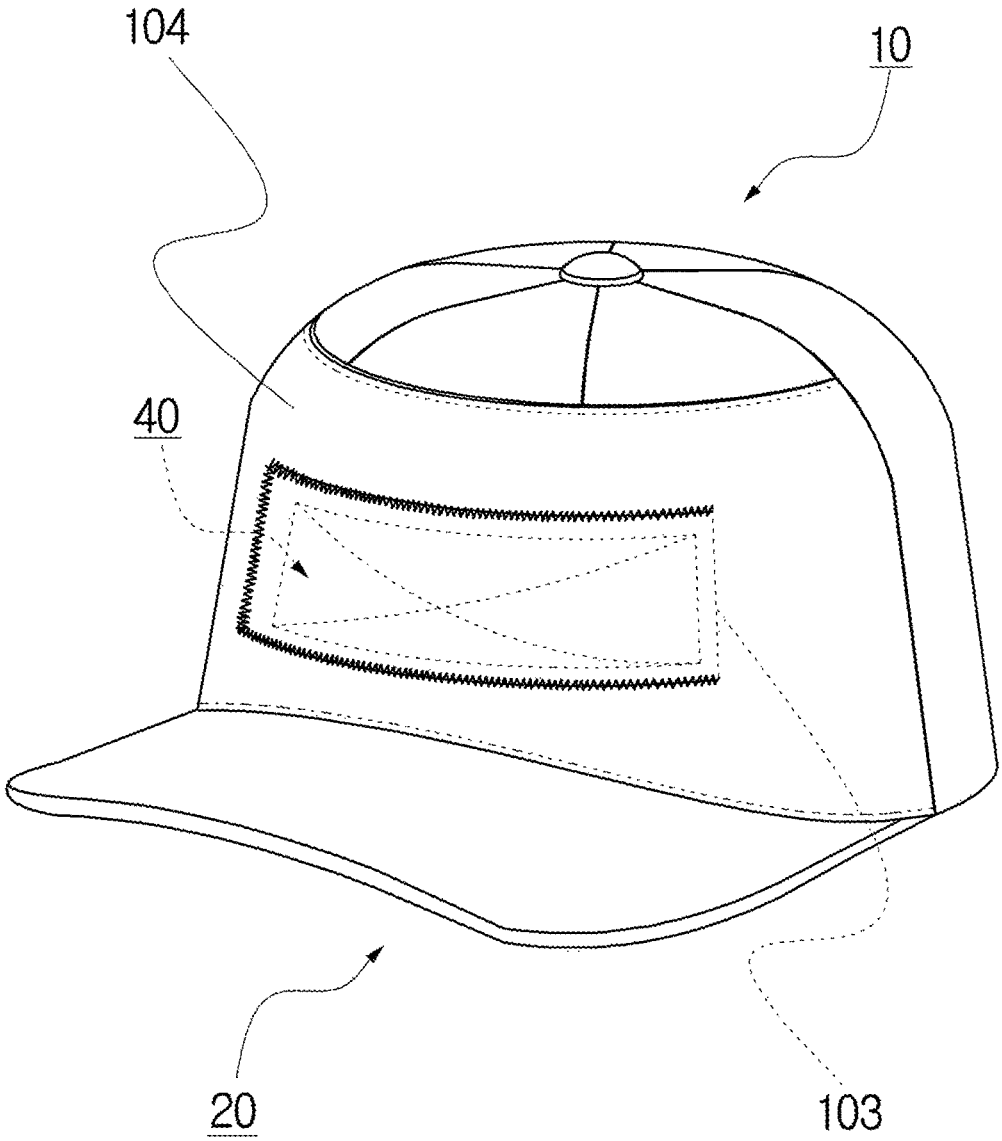
FIG. 7 is a perspective view of a cap equipped with a light emitting device according to a fourth embodiment of the present invention.
Figure 8:
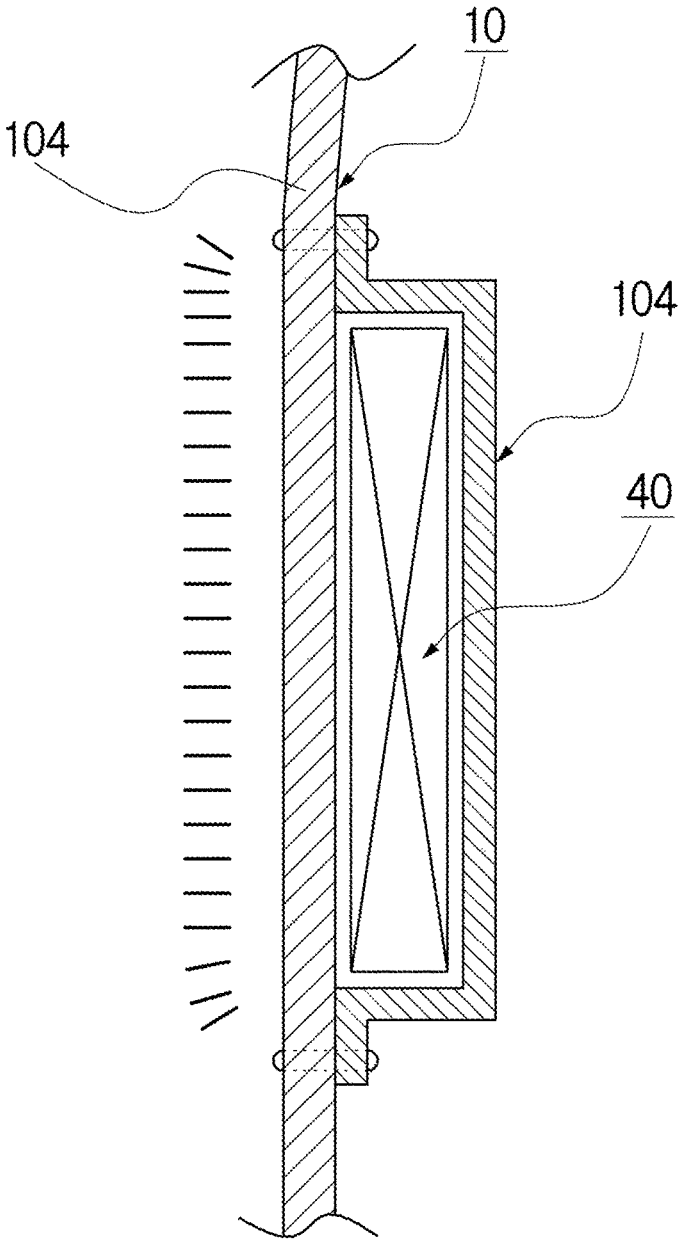
FIG. 8 is a side cross-sectional view of a cap equipped with a light emitting device according to the fourth embodiment of the present invention.

FIG. 7 is a perspective view of a cap equipped with a light emitting device according to a fourth embodiment of the present invention. FIG. 8 is a side cross-sectional view of a cap equipped with a light emitting device according to the fourth embodiment of the present invention.

The present invention is explained referring to FIGS. 7 and 8.

A cap equipped with a light emitting device of the present invention comprises a body part 10, a brim part 20, a pocket portion 103, and a light emitting module 40.

The body part 10 having a space portion formed therein to receive a wearer's head through an opening of the space portion formed downward and comprising a light penetrating member 104 made of material that light penetrates through in a front side of the body part 10.

The light penetrating member 104 is a material that light can penetrate through and may be selected among one of silicone, fabric, net, synthetic resin film, non-woven fabric, but is not limited to.

The brim part 20 is formed to be protruded frontward at a bottom of the body part 10.

Thus, an inner end of the brim part 20 is sewed to the bottom of the body part 10, and the brim part 20 is formed to be protruded frontward from the body part 10, which prevents sunlight.

The pocket portion 103 is formed in rear of the penetrating opening within the space portion 101 of the body part 10.

The pocket portion 103 is preferably formed by sewing three sides of the fabric piece except the opening to the body part 10 but not limited to. The three sides may be detachable from the body part 10 by fixing them to the body part 10 through various fastening means such as Velcro fasteners, snap buttons, magnetic buttons, etc.

Furthermore, to prevent the light emitting module 40 from escaping from the pocket portion 103, the opening of the pocket portion 103 further comprises various fastening means such as Velcro fasteners, snap buttons, magnetic buttons, etc.

The light emitting module 40 can be installed inside the pocket portion 103 in an accessible form to put the light emitting module in and out of the pocket portion 103 and allow the light to be seen through the light penetrating member 104. The light emitting module 40 comprises a light emitting mean 401, a power supply portion 402, a switch 403, and a controller potion 404.

The light emitting module 40 comprises at least one or more of LED to generate light, and more particularly, it is preferable that the light emitting module 40 comprises a LED panel that a plurality of LEDs are arranged on a PCB.

Therefore, a variety of text or image can be displayed through the LED panel.

The power supply part 402 is an element to supply power. The power supply part 402 is preferably equipped with a lithium ion battery, which is capable of repetitive charging, and a charger terminal.

The switch 403 is preferably installed at one side of the light emitting mean 401 or one side of the power supply part 402 to be electrically connected to the light emitting mean 401 and power supply part 402 to control the supply of power.

The controller part 404 is preferably equipped with a driving circuit to control light emitting of the light emitting mean 401 when the controller part 404 is electrically connected to the light emitting mean 401, the power supply 402, and the switch 403, the power supply part 402 supplies power into the light emitting mean 401, and the light emitting mean 401 emits light.

Thus, the controller part 404 allows the light emitting mean 401 to be lights-off, lights-on, or intermittent lights-on.

Also, using an optical illusion by controlling turn on/off of the LED panel with the controller portion 404, a change of a variety of texts or images can be displayed. This enables the cap to be used for various purposes, such as advertisements, sales, promotion, etc., as well as a purpose of fashion accessories.

Embodiments of the present invention are not implemented only through the device and/or operating methods described above but through programs and/or computer readable media.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A cap equipped with a light emitting device comprises:

a body part having a space portion formed therein to receive a wearer's head through an opening of the space portion formed downward;

a brim part formed to be protruded frontward at a bottom of the body part;

a light penetrating member attached to a front side of the body part and made of material that light penetrates through, and a light emitting module installed at one side of the body part to emit light through the light penetrating member, wherein the light penetrating member comprises:

a base part attached to the front side of the body part and made of an opaque silicone material having a first hue, and a light penetrating surface part formed to be protruded frontward from a center of the base part and allowing a receiving space portion formed in rear of the light penetrating surface part to receive the light emitting module.

2. The cap of claim 1, wherein the body part further comprises:

a penetrating opening formed at the front side of the body part, and a pocket portion formed in rear of the penetrating opening within the space portion;

the light penetrating member comprises:

a patch portion attached to the front side of the body part to be located in front of the penetrating opening and made of material that light penetrates through, and a first embroidery portion formed in a front side of the patch portion and made of transparent thread, wherein the light emitting module is installed inside the pocket portion in an accessible form to put the light emitting module in and out of the pocket portion.

3. The cap of claim 2, wherein the light penetrating member further comprises at least one of second embroidery portion formed at one side of the first embroidery portion and made of transparent thread having a different color from that of the first embroidery portion.

4. A cap equipped with a light emitting device comprises:

a body part having a space portion formed therein to receive a wearer's head through an opening of the space portion formed downward and comprising a light penetrating member made of material that light penetrates through in a front side of the body part;

a brim part formed to be protruded frontward at a bottom of the body part;

a pocket portion formed in rear of the light penetrating member within the space portion, and a light emitting module installed inside the pocket portion in an accessible form to put the light emitting module in and out of the pocket portion, wherein the light penetrating member comprises:

a base part attached to the front side of the body part and made of an opaque silicone material having a first hue, and a light penetrating surface part formed to be protruded frontward from a center of the base part and allowing a receiving space portion formed in rear of the light penetrating surface part to receive the light emitting module.

* * * * *